US005676125A

United States Patent [19]

Kelly et al.

[11] Patent Number: 5,676,125

[45] Date of Patent: Oct. 14, 1997

[54] EXCAVATOR MOUNTED CONCRETE SAW

[76] Inventors: Patrick Kelly, P.O.Box 640, R.R. #1, Mitchell, Ontario, Canada, N0K 1N0; Gene Beehler, R.R. #3, Stratford, Ontario, Canada, N5A 6S4; George Lannin, 68 St. David Street, Mitchell, Ontario, Canada, N0K 1N0

[21] Appl. No.: 494,057

[22] Filed: Jun. 23, 1995

[51] Int. Cl.[6] ..... B28D 1/04

[52] U.S. Cl. ..... 125/13.03; 30/379.5; 83/488; 83/928; 125/14; 299/75; 299/76; 451/236

[58] Field of Search ..... 30/379, 379.5; 83/488, 489, 490, 928; 125/12, 13.01, 13.03, 14; 299/72, 75, 76; 451/236

[56] References Cited

U.S. PATENT DOCUMENTS

| | | | |
|---|---|---|---|
| 3,649,071 | 3/1972 | Graff | 299/75 X |
| 4,134,459 | 1/1979 | Hotchen | 125/14 X |
| 4,233,954 | 11/1980 | Visser | 125/14 |
| 4,353,275 | 10/1982 | Colville | 83/488 |
| 4,433,871 | 2/1984 | Bertrand | 299/75 X |
| 4,832,412 | 5/1989 | Bertrand | 125/14 X |
| 4,836,494 | 6/1989 | Johnsen | 125/14 X |

*Primary Examiner*—Timothy V. Eley

[57] ABSTRACT

Rotary disk saw is adapted to be mounted on an earth excavator or the like, having an articulating and rotatable member for a boom. To this excavating boom, which normally carries a shovel, the saw carrying unit is attached and includes a compound pivot means adapted for orthogonal and transverse rotation about the bucket, the same carrying a saw carrying boom and a carriage which travels up and down the boom, hydraulically driven, to locate a sub-carriage which transversely locates a rotary disk saw. By a relative rotating of compound pivot means and the boom and by locating the carriage and sub-carriage, as required, the saw may be positioned onto a working piece which is to be cut. Such devices are especially suitable for demolition of highway bridges and the like.

11 Claims, 5 Drawing Sheets

EXCAVATOR MOUNTED CONCRETE SAW

This invention relates to an excavator mounted concrete rotary saw, particularly being made to attach to the boom of an hydraulic excavator, or backhoe whether mounted on a crawler or on wheels.

BACKGROUND TO THE INVENTION

In concrete demolition, whether of buildings or of highway structure such as bridges and the like, it is desirable to have a concrete cutting saw for severing concrete slabs, railings, sidewalks or curbs or similar structures which for simplicity shall hereinafter be referred to as concrete slabs, whether re-inforced with re-inforcing rods or not. This is particularly necessary in the repair and reconstruction of bridges which may have deteriorated in part over time because of weathering and particularly, in Canada and in the northern states of the United States of America, because of the use of calcium or salt on the roadways in winter in order to reduce ice.

THE INVENTION

It is an object of the invention to create a highly mobile hydraulically driven concrete rotary saw so as to reach in some of the more difficult access areas required in the removal or repair of a concrete slab and thus, avoid the use of a jackhammer which chips away at the weathered concrete. A jackhammer generally requires operation by a single operator but more recently has been put on booms but nevertheless the eroding action of a jackhammer is slow and a much faster way would be to utilize a concrete rotating disk saw. Jackhammers can cause damage to sound adjacent concrete that remains while the use of a disk saw disects the concrete components, preserving the sound concrete and allowing removal of the unsound or debris concrete.

The invention therefore contemplates a rotary disk saw including a saw carrying unit adapted for mounting onto a member that may be an articulating and rotatable element such as a bucket of an earth excavator, the saw carrying unit comprising articulating means carried by said member, a saw carrying boom carried by the articulating means, a saw carriage, adapted to travel to and fro along the boom, including, a transversely oriented sub-carriage carrying means, a sub-carriage adapted to travel along the sub-carriage carrying means and housing, a disk saw adapted for rotation about its rotational axis and, a prime mover for rotating the saw about its rotational axis; and, means for travelling the sub-carriage to and fro along the sub-carriage carrying means to position the sub-carriage and saw at a selected distance from boom and means for pivoting and rotating the boom and hence, the saw, relative to the member.

More specifically, the invention Contemplates that the articulating means (A) is a compound pivot means and preferably includes a beam attachment means defining an aperture, a shaft adapted to rotate in and to be held by said aperture, the shaft defining, at its lower distal end, a transversely oriented boom pivoting aperture and a pivot means mounted centrally on the boom and adapted to pivot in the boom pivoting aperture. Further, the saw is adapted to move orthogonally relative to the boom as well as to and fro along the boom, allowing accurate positioning of the saw. The rotation of the saw is by an hydraulic motor and the angulation of the boom, its attack, pitch and yaw are controlled by hydraulic cylinders.

BRIEF DESCRIPTION OF THE DRAWINGS

The invention will now be described by way of example and reference to the accompanying drawings.

THE PREFERRED EMBODIMENT

Figure 1:
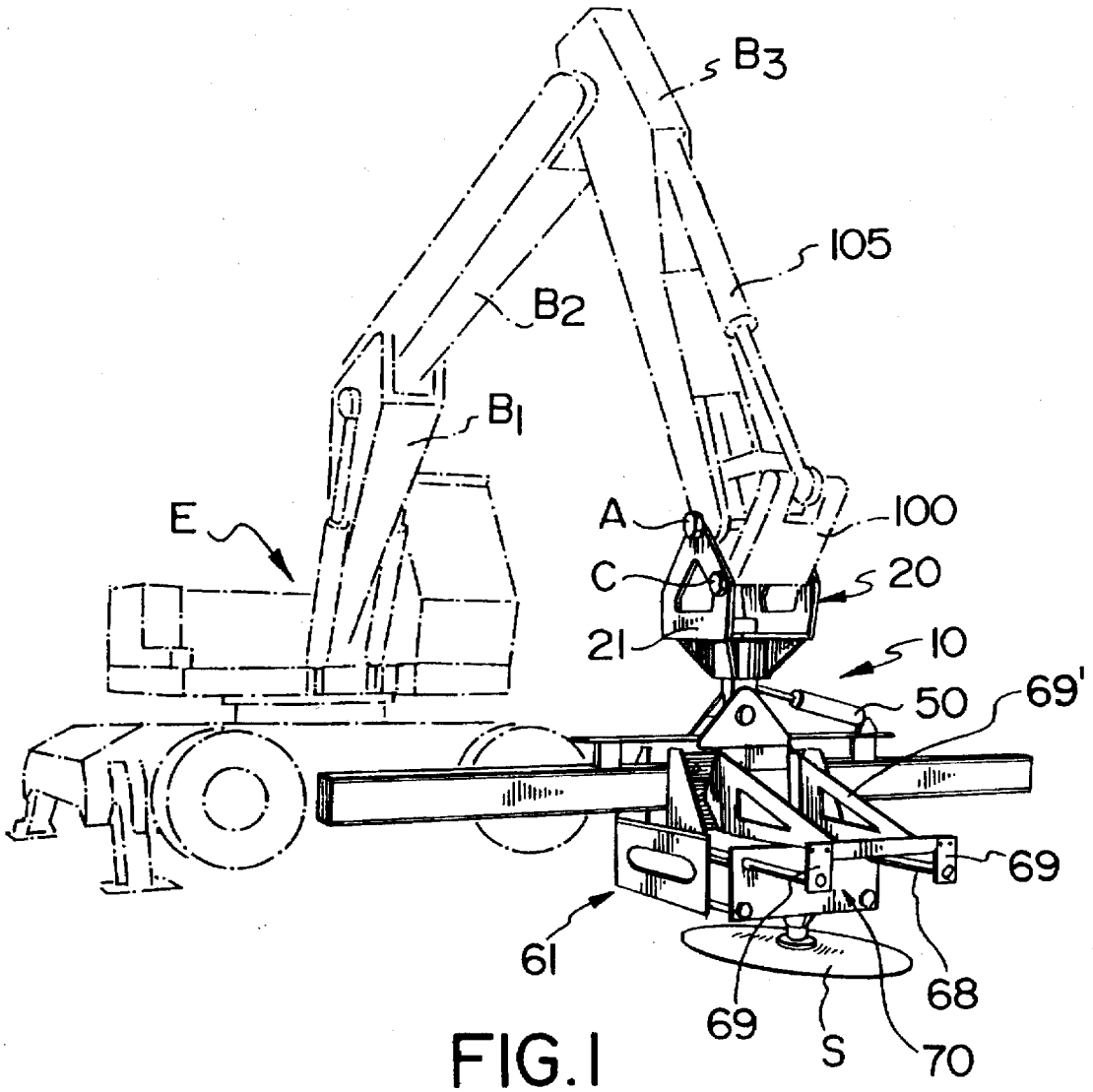
FIG. 1 is front perspective view with saw blade shown centered on a boom.

Referring to FIG. 1, an excavator (E) is shown in phantom with a three-am articulating boom, $B_1$, $B_2$, $B_3$, the distal end of which carries an articulating bucket that further carries an hydraulically driven rotary saw carrying unit (10), according to the invention.

The saw carrying unit (10) encompasses a boom attachment means (20). Now also referring to FIGS. 1 and 7, the boom attachment means (20) consists of two triangular pieces (21) welded to a base plate (22) defining a central aperture (23) through which extends the shaft portion (240) of a compound pivot means (24) defining a saw boom pivoting aperture (25) oriented orthogonal to the triangular pieces (21). The shaft portion (240) is pivotly held in the aperture (23) by a holding cover plate (26) defining a plurality of apertures (27) through which screws, not shown, threadingly engage corresponding threaded apertures (28) in the upper face of the shaft portion (240). The plate (26) has diametrically extending arms defining apertures (26'), one of which, as it will be explained hereafter, acts as a pivot point to rotate the shaft (240) relative to the base plate (22) and the boom attachment means (20).

Compound pivot means (24) extends beneath the shaft portion (240) as a lower lug portion (241) with vertical end faces (242) which extend through a curvature face (243); the side faces thereof being recessed flat side faces (244) having an upper arcuate cut (245); the faces during the aperture (25) which is bored orthogonally therethrough, so as to provide an articulating interface for articulation of the boom (30), as will be later described.

The triangular pieces (21), each have an apex aperture and one corner aperture, the apex aperture adapted to accommodate bolt (A) and the corner aperture adapted to carry a corner bolt (C). Bolt (C) extends through the distal pivoting end or bucket (100) of boom (B) which is articulated for pivoting by an hydraulic cylinder (105), as those skilled in the art will know.

Figure 5:
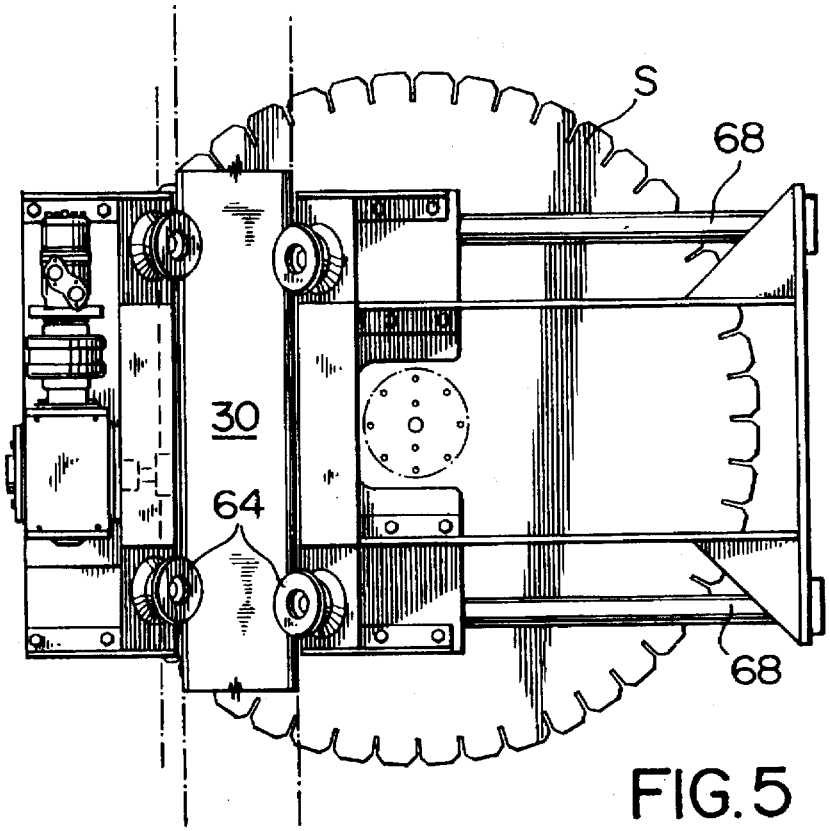
FIG. 5 is an enlarged detail plan view of the saw.
Figure 7:
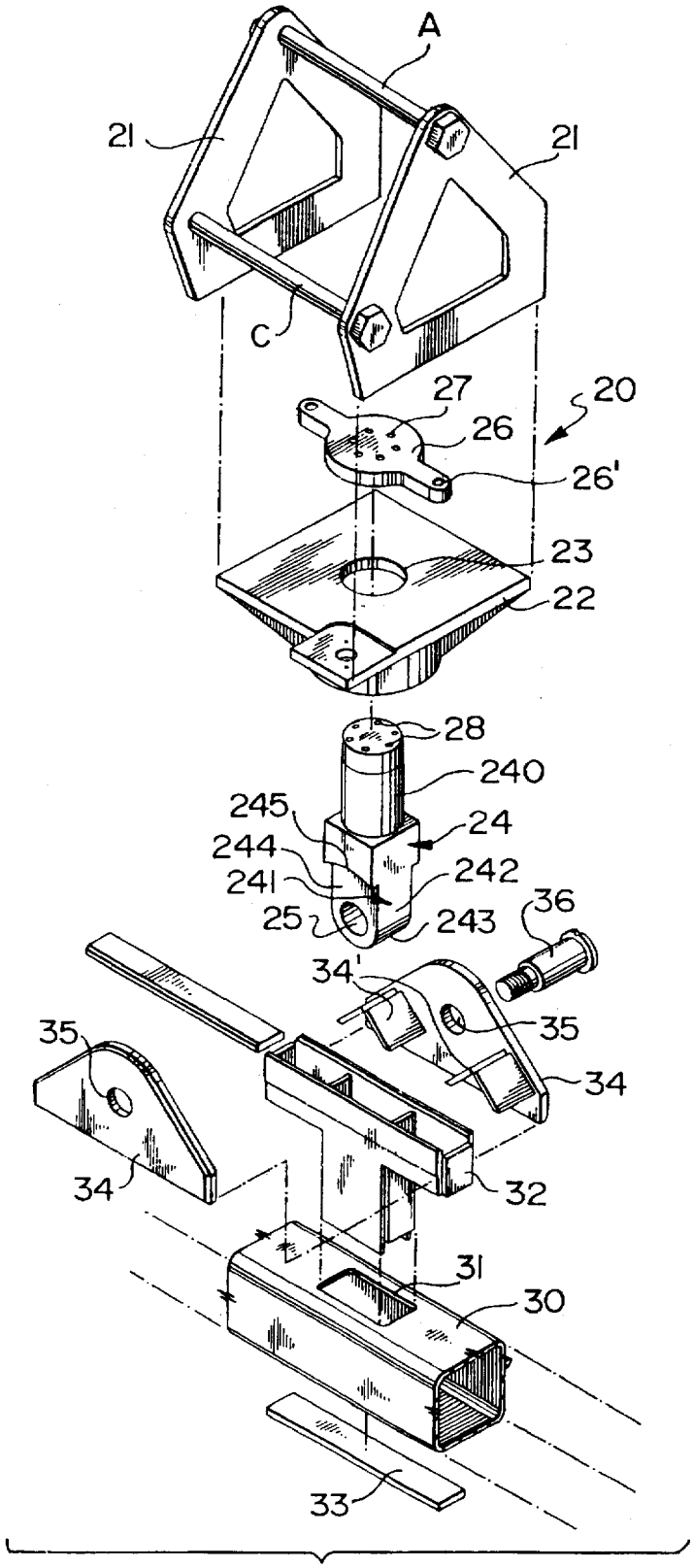
FIG. 7 is a perspective assembly view of the attachment means attaching the saw to the end of an hydraulic boom.

The saw carrying unit (10), and now referring to FIGS. 1, 5 and 7, includes a laterally oriented pivotable rectangular, in section, bar or boom (30) through which there are square apertures (31), in the upper and lower surfaces, as seen in FIG. 7. A "T" piece (32) fits through the square apertures (31) and a bottom plate (33) is welded to the bottom of the bar (30) and to the base of the "T" piece (32) to secure it into position. Two end triangular members (34) define apertures (35) and are welded to opposite sides of the upper body of the "T" bar (32) and a bolt (36) extends through the apertures (35) and (25) and a nut, not shown, removably secures the same. This provides orthogonally, pivotable movement of the bar (30) relative to the boom $B_3$, each interface of the triangular member (34) has an internal inverted "L" piece extending between each inner surface of the members (34) and having an inwardly declining slope surface (34'), more clearly seen in FIG. 7. The position of the inclined faces (34') are positioned such that they act as a shoe against the curvature face (243) of the compound pivot means (24), while the upper portions of the inner surfaces of the triangular members (34) urge against the recessed faces (244). The assembly is held together, of course, by bolt (36). In this fashion, when the compound pivot means (24) is rotated within its aperture (23), the boom itself rotates relative to it in the same plane while orthogonal rotation to that plane is achieved by rotation of the boom about pin (36), as will become apparent.

Figure 3:
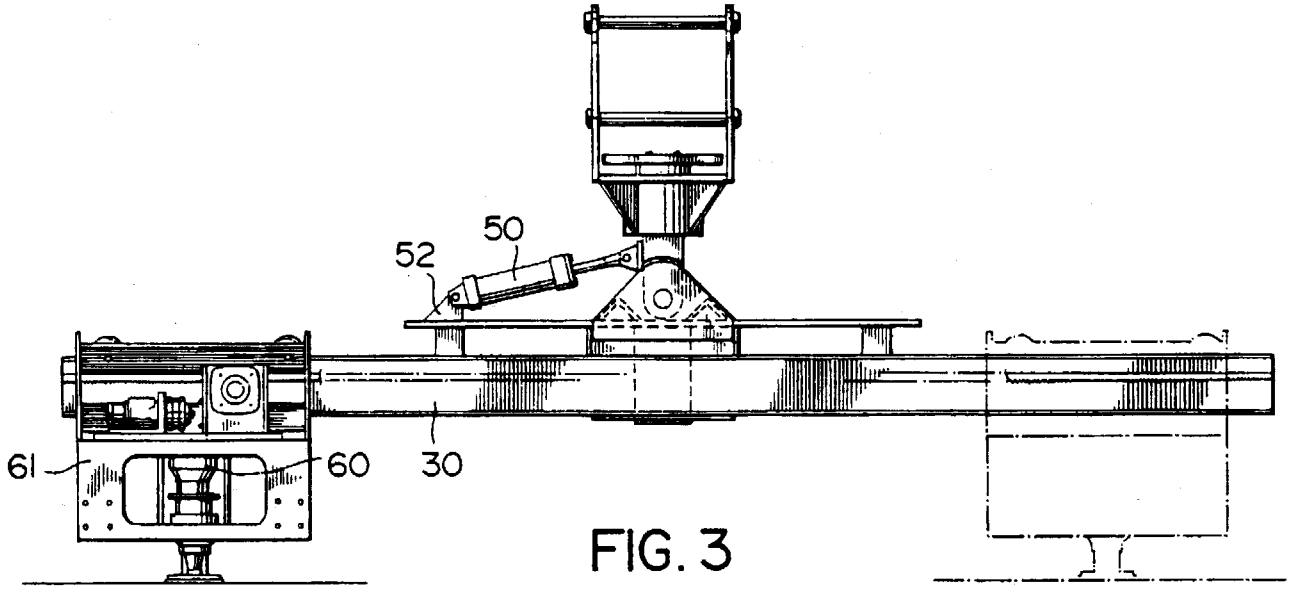
FIG. 3 is a rear elevational view.
Figure 4:
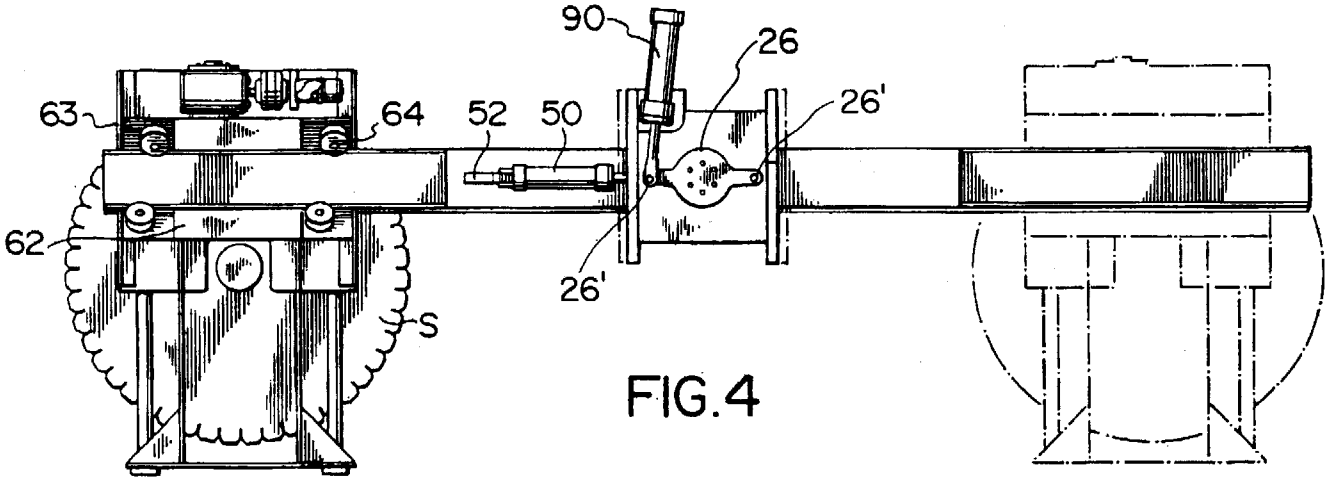
FIG. 4 is a top plan view.

As more clearly seen in FIGS. 1, 3 and 4, there is an hydraulic cylinder (50), which has its telescoping rod distal end hingeably attached to the compound means, (24) and this cylinders opposite end pivotly attached to an upstanding bracket (52) mounted on the saw carrying boom (30). By extending the piston cylinder (50), or contracting the same, the boom 30 rotates to tilt the boom (30) longitudinally about the pivot pin (36), thereby providing relative to the boom ($B_2$), orthogonal and longitudinally angular positioning of the saw (10).

The saw (10) has a rotary cutting or saw blade (S) which is mounted for rotation on an hydraulic motor or prime mover (60) which itself is housed on a movable saw carriage (61) which is adapted to hydraulically travel to and fro along the boom (30) from the phantom to the solid positions, as shown in FIGS. 3 and 4. The carriage (61), on its top side, has two angle plates (62) and (63) which respectively carry two oppositely located upper pair of passive idlers (64), engaging the upper surface of the boom (30) at one end of the carriage (61) and a similar upper pair at the other end; the four engaging the upper surface of the rectangular-in-section boom (30), as more clearly seen in FIG. 5. In a mirror fashion, there are two lower pairs of passive idlers (64) engaging the lower surface of the boom to stabilize the carriage (61) for rolling movement along the boom (30). Preferably, these four pairs of idlers .(64) are inclined to engage the respective corners of the square boom (30) to allow easy travel of the carriage (61) along the boom (30), as will now be explained.

Figure 2:
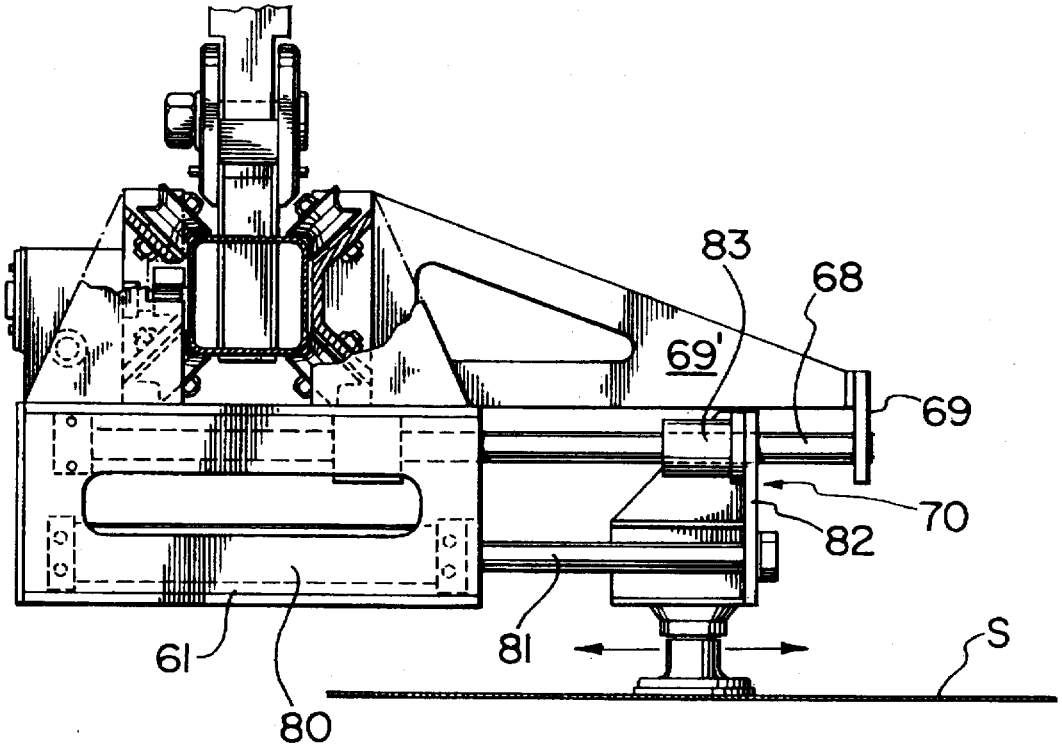
FIG. 2 is a left elevational view.
Figure 6:
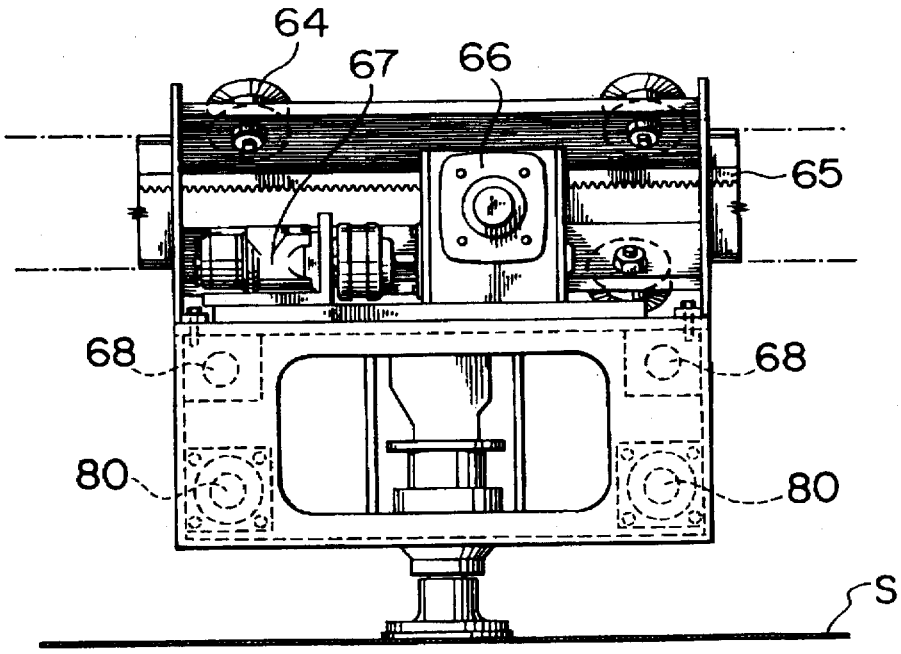
FIG. 6 is a rear elevational view of the saw carriage, according to the invention.

On the inside surface of the boom (30), as seen in FIGS. 5 and 6, there is a longitudinal toothed element or rack (65) which extends along the total length of the boom (30) into which is engaged a worm gear, not clearly seen, but an integral part of a worm gear drive (66) that includes an hydraulic motor (67) to drive the worm gear (not shown) clockwise or counter clockwise and to engagingly travel the same to and fro along the rack (65), selectively locating the carriage (61) and the saw blade (S) at a position convenient on the boom (30). The saw carriage (61) has an orthogonally oriented saw carrying sub-carriage (70) mounted for travel along two fix upper parallel traversely extending cylindrical rails (68) whose distal ends are secured to end bars (69) and a cross member (69') which is carried by two orthogonally oriented triangular sub-carriage support members (69) welded, bolted or otherwise secured to the carriage (61). Beneath the rails (68) are a pair of hydraulic cylinders (80), the distal end of the piston (81) for each hydraulic cylinder (80) is terminated on an end plate (82) defining two apertures through which the rails (68) extend and carry a bushing (83) which slides along the rail (68) to carry the saw (S) to and fro traversely and in the direction of the arrows shown in the side elevational view of FIG. 2.

Referring to FIG. 4, there is a further hydraulic cylinder shown as (90) which has its distal end of the rod thereof pivotly mounted to the plate (26) and when this cylinder is activated, the pivot link (24) is rotated, as is the boom (30). With the use of the boom piston (105) and cylinder (90), appropriate angulation and location of the saw (S) may be achieved to suit the needs in the working environment.

I claim:

1. A rotary disk saw including a travelling saw carrying unit adapted for mounting onto a member that may itself be an articulating and rotatable element relative to a tractor for transporting the same, the saw carrying unit comprising:

(a) articulating means carried by said member;

(b) a saw carrying unit carried by the articulating means and articulatingly carrying a longitudinal saw carrying boom;

(c) a saw carriage, adapted to travel to and fro along the boom, the saw carriage having, (i) a saw carrying sub-carriage oriented to travel traverse to the boom;

(ii) means to travel the saw carrying sub-carriage traverse to the boom, the saw carrying sub-carriage carrying, (A) a rotary disk saw adapted for rotation about its rotational axis and, (B) a prime mover for rotating the disk saw about its rotational axis, (C) means for travelling the saw carrying sub-carriage longitudinally along the saw carrying boom whereby to position the rotary saw at any position on the boom; and, (d) means for pivoting and rotating the boom relative to the articulating means and hence, the rotary saw, relative to the member.

2. The rotary disk saw as claimed in claim 1, wherein the transversely oriented saw sub-carriage carrying means includes:

(I) a relatively orthogonally oriented pair of parallel rails wherein the saw sub-carriage includes means for glidingly travelling along the rails.

3. The rotary disk saw as claimed in claim 2, wherein the means for travelling the saw sub-carriage, is an hydraulic cylinder telescopingly attached between the saw carriage and the saw sub-carriage.

4. A rotary disk saw including a saw carrying unit adapted for mounting onto an articulating and rotatable member that may be a bucket of an earth excavator, the saw carrying unit comprising:

(a) compound pivot means adapted for rotary attachment to said member;

(b) a saw carrying boom pivotly mounted to the compound pivot means for pivoting and rotating the saw carrying boom relative to the compound pivot means;

(c) a saw carriage, adapted to travel to and fro along the boom, including, (i) a transversely oriented saw carrying sub-carriage, the sub-carriage adapted to travel orthogonal to the boom carrying, (A) a disk saw adapted for rotation about its rotational axis and, (B) a prime mover for rotating the saw about its rotational axis, (C) means for positioning the saw sub-carriage at a selected distance from boom;

(d) boom pivot means adapted to pivot the boom about the pivot means; and, (e) boom rotation means adapted to rotate the boom relative to the member.

5. The rotary saw as claimed in claim 4, wherein the compound pivot means includes:

(f) a boom carrying means defining a first aperture;

(g) a shaft adapted to rotate in and to be held by said aperture, the shaft defining, at a lower distal end, a transversely oriented boom pivoting aperture; and, (h) a pivot post defining a second aperture, the pivot post mounted centrally on the boom; and, (i) a boom holding pin extending between first and second aperture.

6. The rotary disk saw as claimed in claim 5, including a plate carried by the distal end of the shaft and wherein the boom rotation means is a first hydraulic cylinder pivotly attached said plate and to the compound pivot means whereby the selective length of the first hydraulic cylinder determines the rotational position of the shaft and boom.

7. The rotary disk saw as claimed in claim 5, wherein the boom pivot means includes an aperture with a pivot pin extending therethrough and the boom pivot means and a second hydraulic cylinder pivotly located between the boom and the articulating means whereby the selective length of the second hydraulic cylinder determines the pivotable angulation of the boom relative to the articulating means.

8. The rotary disk saw as claimed in claim 4, wherein the saw sub-carriage has four pairs of rollers mounted for travelling engagement along the boom.

9. The rotary disk saw as claimed in claim 8, wherein the means for travelling the saw sub-carriage includes a longitudinal tooth element mounted on the boom, means for travellingly engaging the tooth element and for moving to and fro therealong to locate the saw sub-carriage at a selected position along the boom.

10. The rotary disk saw as claimed in claim 4, wherein the transversely oriented sub-carriage carrying means includes:

(I) a relatively orthogonally oriented pair of parallel rails wherein the saw sub-carriage includes means for gliding travelling along the rails.

11. The rotary disk saw as claimed in claim 10, wherein the means for travelling the sub-carriage is an hydraulic cylinder telescopingly attached between the saw carriage and the saw sub-carriage.

* * * * *